US006298561B1

(12) United States Patent
Decker

(10) Patent No.: US 6,298,561 B1
(45) **Date of Patent: *Oct. 9, 2001**

(54) TOOL FOR CUTTING SANDWICH TYPE PLASTER BOARDS

(76) Inventor: Erich Decker, Oberbernbacherweg 10, 86551 Aichach (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/227,738

(22) Filed: Jan. 8, 1999

(30) Foreign Application Priority Data

Jan. 9, 1998 (DE) ..... 198 00 582
Jun. 22, 1998 (DE) ..... 198 27 703

(51) Int. Cl.[7] ..... B26B 25/00

(52) U.S. Cl. ..... 30/265; 30/279.2; 30/280; 30/289; 30/292; 83/873; 83/875; 83/495

(58) Field of Search ..... 30/265, 289, 279.2, 30/280, 292; 83/51, 495, 873, 875

(56) References Cited

U.S. PATENT DOCUMENTS

| | | | | |
|---|---|---|---|---|
| Re. 32,501 | * | 9/1987 | Okada | 30/292 |
| 1,424,050 | * | 7/1922 | Thomas et al. | 83/485 X |
| 2,529,210 | * | 11/1950 | Butler | 30/394 X |
| 2,578,346 | | 12/1951 | Florian . | |
| 2,641,834 | * | 6/1953 | Bobrowski et al. | 30/292 |
| 2,706,002 | * | 4/1955 | Whittamore | 30/292 |
| 3,174,225 | * | 3/1965 | Abraham | 30/292 |
| 3,644,994 | * | 2/1972 | Lind | 30/292 |
| 3,889,862 | * | 6/1975 | Insolio et al. | 83/582 X |
| 4,301,594 | * | 11/1981 | Okada | 30/292 |
| 4,417,883 | | 11/1983 | Granger . | |
| 4,432,137 | * | 2/1984 | Okada | 30/292 |
| 4,614,138 | | 9/1986 | Altman . | |
| 5,027,515 | * | 7/1991 | Murdock | 30/292 |
| 5,197,195 | | 3/1993 | Aikens . | |
| 5,404,647 | | 4/1995 | Prater . | |
| 5,471,753 | | 12/1995 | Rodriguesian . | |
| 5,488,773 | * | 2/1996 | Fletcher | 30/293 |
| 5,493,781 | * | 2/1996 | Saito | 30/292 |
| 5,600,892 | * | 2/1997 | Peugh et al. | 30/292 |

OTHER PUBLICATIONS

"Streifenschneider" undated brochure in German.

* cited by examiner

*Primary Examiner*—M. Rachuba
(74) *Attorney, Agent, or Firm*—Lawrence E. Laubscher

(57) ABSTRACT

The present invention is directed to a tool for cutting sandwich type plaster boards such as gypsum plaster boards. It is an object of the present invention to provide a tool which allows the exact cutting of those boards in a time saving manner. According to the present invention this object is performed by a tool for working board-like workpieces, in particular sandwich type plaster boards, comprising a guide means for guiding the tool, a handle means, a blade means for forming a cut in the workpiece, and a coupling means for coupling the blade means with the guide means in an adjustable manner. A spacing between the handle means and the blade means may be adjusted by said coupling means in a direction transversely to a moving direction of the blade means.

2 Claims, 4 Drawing Sheets

Figure 1:
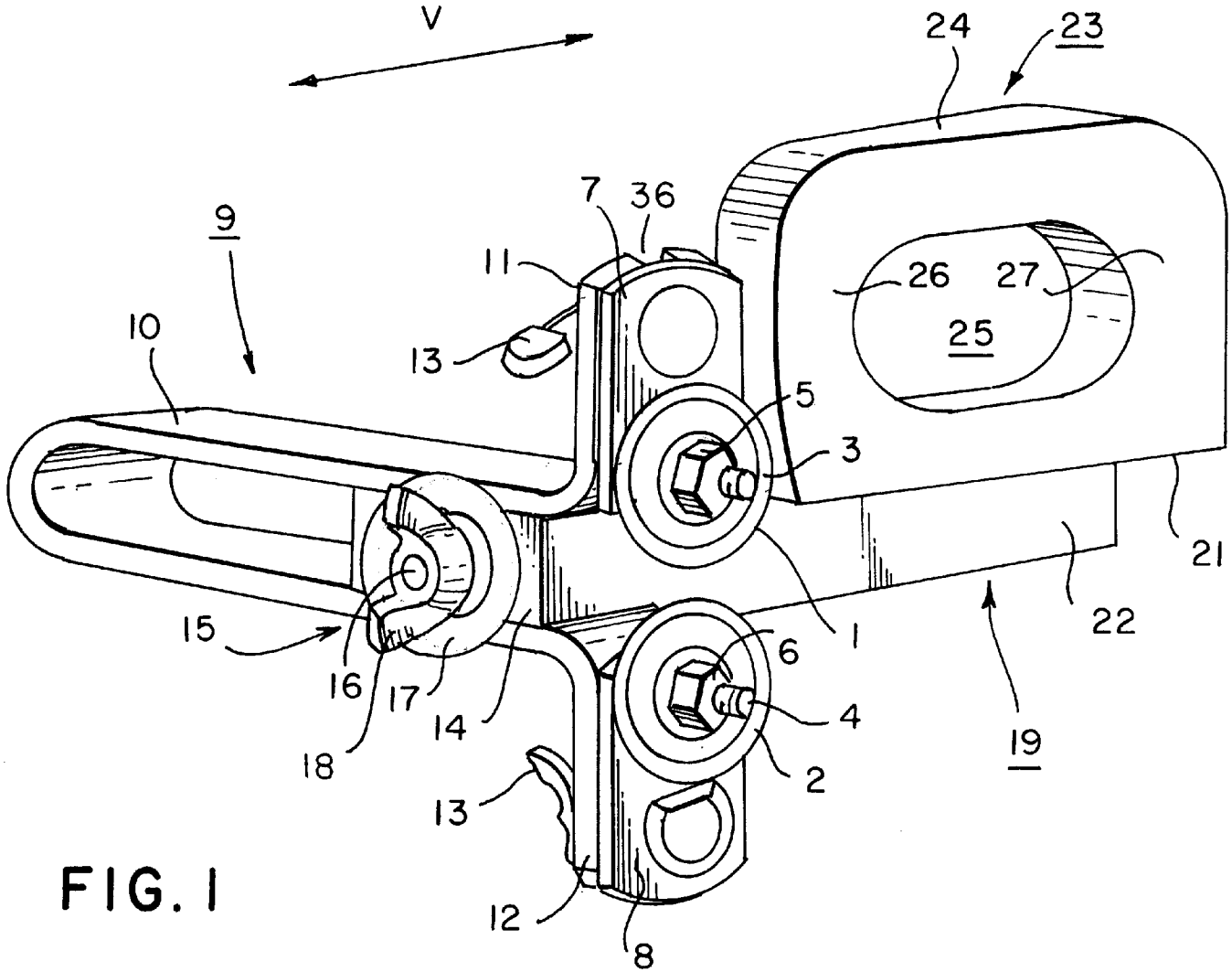

FIG. 3
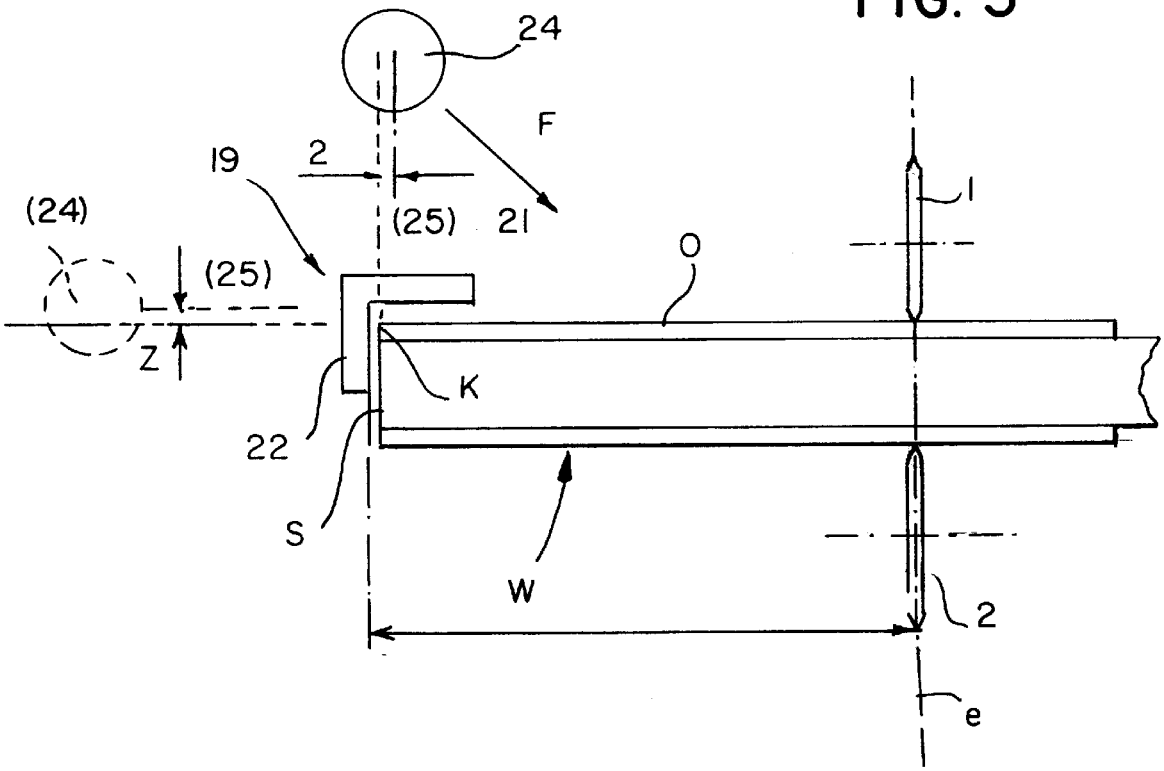
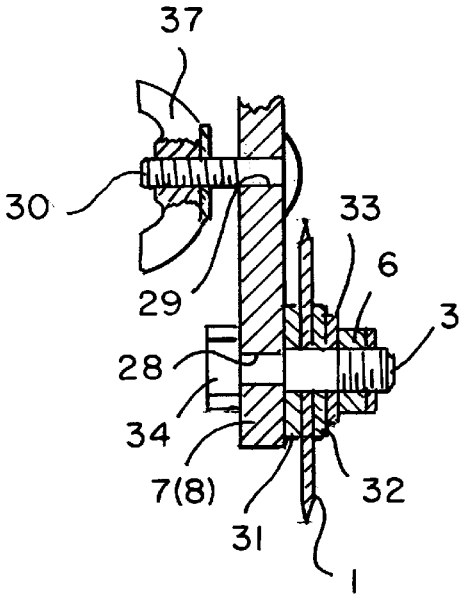
FIG. 4

TOOL FOR CUTTING SANDWICH TYPE PLASTER BOARDS

FIELD OF THE INVENTION

The present invention refers to a tool for working board-like workpieces, in particular for working sandwich type plaster boards.

BACKGROUND ART

Sandwich type plaster boards such as gypsum plaster boards are to an increasing degree used in the building of houses. These boards are usually attached by means of screws onto a portative sub-structure. Large-surface walls can be established by assembling a plurality of boards. The joints formed between the individual boards can be filled by means of a filler material. Preferably a tape-like fleece material is put onto the filled joints which is finally smoothened.

Since in gypsum plaster boards the outer layers thereof significantly contribute to the strength of these boards, it proved to be advantageous in view of a high-quality processing of these boards to cut these boards comparatively precisely when needed so that the outer cover layers extend in an undamaged condition to the precisely defined edge of the board.

Cutting said boards to size is usually made by using a saw or a knife. Using a saw, the board can be easily separated completely. The edges are, however, relatively rough and are possibly jagged. When using a knife a smooth cutting edge can be achieved at least on one side of the board. In order to obtain a straight cut the use of a guide rail is imperative. When making short cuts, this guide rail can usually be held by hand. When making longer cuts, it is convenient to fix the guide rail for instance by means of screw clamps. If, however the guide rail is not fully straight or the board bends under the guide rail when being cut, there is a risk that the board is cut inaccurately and the blade of the knife does not penetrate sufficiently deep into the board so that a clearly defined separation line is not attained.

SUMMARY OF THE INVENTION

Facing this problem, the object of the invention is to provide a tool for cutting-to-size board-like workpieces, in particular gypsum plaster boards by means of which comparatively precise cuts can be made in a time-saving manner.

By the tool of the invention a clear cut is achievable having a precise edge of cut or notch in a board without the workpiece having to be marked or a guide rail having to be used.

An embodiment of the invention which is especially advantageous in view of an especially safe guide of the tool is provided in that the guide means has a lateral guide face which can be abutted with a side face of a workpiece. It is possible to provide this guide face with profiles and/or with a slideway lining.

To support the tool on the workpiece, the guide means is preferably designed in a manner that it comprises a rest-guide face which can be engaged with the flat side of a workpiece. Both guide faces are preferably arranged in a manner that the lateral guide face and the rest-guide face are substantially orthogonal to one another. In a corner portion formed between the two guide faces, a longitudinal recess of low depth is preferably provided into which possible projections in the end portion of the workpiece can penetrate without deflecting the guide means. If the existing workpiece edges do not allow a sufficiently precise guide of the tool, an especially precise guide of the tool can be achieved in that the guide means can be brought into guiding engagement with a guide ruler. Such a guide ruler preferably consists of an extruded profile, made for instance of aluminum.

An especially advantageous embodiment of the invention is given in that the coupling means comprises a rail element preferably formed of a flat steel profile. This rail element can preferably be fixed in the area of the guide means. The length of this rail element is in the range between 12 to 48 inches. The rail element substantially extends perpendicular to a tool moving direction.

The rail element is preferably arranged such that the flat side thereof is substantially aligned in parallel to the workpiece surface. This leads to an especially high flexural strength against possible forces directed in the tool moving direction.

An infinitely variable adjustability regarding the cutting depth is given according to a preferred embodiment in that a clamping means is provided for clamping the rail element in the area of the guide means. A sufficiently large clamping force can be achieved in that the clamping means comprises a clamping screw. This clamping screw is in an advantageous manner provided with a turning knob and can be turned manually, without the use of a tool, into a clamping or release position.

The blade means is, according to a special aspect of the present invention, preferably formed by a rolling blade element. The rolling blade element preferably has a diameter of preferably 0.3 to 2.4 inches. According to a preferred embodiment, the rolling blade element is supported in such a manner that a predetermined braking torque acts at the rolling blade element. The braking torque can adjusted according to the respective need. The rolling blade element is in an advantageous manner set onto a threaded stem, wherein a force acting on two brake discs can be adjusted via a polystop nut.

An especially favorable positioning of the rolling blade element can be achieved in that the blade means is attached at a carrier element. This carrier element allows a displacement of the blade element without the polystop nut preferably provided on the threaded stem for supporting the blade element having to be loosened.

The carrier element is attached at the rail element preferably through an angular holding member. The second handle means is fixed at and end portion of the rail element preferably through this holding member. It is also possible to adjustably attach the second handle means at the rail element.

The second handle means is attached according to a special aspect of the present invention in a manner that this handle means is arranged above the blade means when setting the tool onto a horizontally aligned board. A line extending orthogonally to the plane of the board and to a contact portion of the blade element extends preferably through the second handle means.

An embodiment that is especially advantageous from the ergonomic point of view is given in that the second handle means has a substantially spherical knob. In particular in combination with a second handle means that is designed in that manner, it is advantageous in view to a reliable guide of the tool to provide the first handle means with an elongate handle section. The handle section extends in an advantageous manner in the tool moving direction.

In view of an especially favorable handling of the tool, it is advantageous that a passage section is formed between the handle section and the guide means, and that the handle section has an end portion that is connected to the guide means. An especially stable embodiment is given in that the handle section and the guide means are formed integrally.

An especially robust fixing of the rail element can be achieved in that a fixing pin section is provided which is formed integrally with the guide means and that the clamping means comprises a clamping bracket element which can be set onto the fixing pin section for clamping the rail element at the guide means.

A simple and precisely positioned adjustability of the cutting width is given in that the rail element is provided with a scale for indicating the adjusted cutting width.

When working sandwich type plaster boards, in particular gypsum plaster boards, it is sometimes required to cut small strips off these boards in order to cut the boards to a predetermined size or to create strips of a predetermined width for further processing.

When processing gypsum plaster boards or cellulose boards, strips of that kind can be produced by slightly slitting the surface of the boards on both sides. After forming a separation line by preparatorily slightly slitting the boards on the both sides, e.g. by means of a rolling cutter blade, these boards are laid onto a rest face and are drawn forwards over a front edge of the rest face to an extent that the separation line marked by the slitting process is positioned beyond said front edge. The projecting strip portion of the board is then pressed downwards with a short, heavy jerk. The strip portion breaks off the remaining board along the marked separation line.

In particular when separating comparatively small strips or when processing thin boards there is a risk of the strips breaking. The breaking point is frequently in the area of an insufficiently deep slitting of the board surface. The depth of the slitting may be influenced by the pressure of an appropriate blade. In case of a high pressure there is a risk of the cutting tool running off.

The tool presented by a particular, favorable embodiment of the invention makes it possible in an advantageous manner to provide two relatively deep notch positions on both sides of the workpiece without the risk of the tool running off because of forces acting at the blade elements. The tool according to the invention can also be safely operated with one hand. The other hand can hold the workpiece, in particular the strip portion to be cut off.

An embodiment of the invention that is advantageous in view of a one-hand operation of the tool is given in that the handle means comprises a handle section, wherein the handle section is provided such that this handle section is arranged over an upper side of the workpiece when setting the tool onto the workpiece. It is then possible in an advantageous manner to force the tool against the upper side of the workpiece. The upper side of the workpiece, i.e. the section of the flat workpiece side adjoining the workpiece edge, forms a slide face which supports the tool perpendicularly to the feed direction and perpendicularly to the board plane.

An especially favorable guide of the tool is enable in that the handle section is arranged on the same level as the workpiece edge above the upper side of the workpiece when setting the tool onto the workpiece. In an advantageous manner does a central axis of the handle section extend in parallel to the feed direction. The central axis of the handle section is arranged slightly inwards, i.e. inwardly offset from the workpiece edge, when looking at the tool from a perspective vertical to the workpiece level. Thereby a tilting of the tool is effectively prevented. The distance of the central axis of the handle section from the workpiece edge measured perpendicular to the upper workpiece side is in an advantageous manner at least about 2 inches to a maximum of about 6.3 inches. With these dimensions, possible tilt torque can be reliably absorbed by relatively low hand power without the risk of the tool running off.

According to a preferred embodiment of the invention, the guide means has a first guide section, with the workpiece extending on the upper side thereof. This first guide section is formed in an advantageous manner by a substantially planar first bearing face. As an alternative it is also possible to form the guide section by a guide roller means. Such a guide roller means comprises in an advantageous manner at least two spaced apart roller elements arranged successively in the feed direction, preferably formed of a soft material.

An especially stable movement of the tool is achieved according to a preferred development in that the guide means has a second guide section which extends on a lateral face of the workpiece. It is possible by these two guide sections to force the tool by means of a pressure force directed transversely to the moving direction, against the side face of the workpiece and against the upper side of the workpiece. The tool slides in a stable manner on said two workpiece faces. The second guide section is formed in an advantageous manner by a substantially planar second bearing face. Possible irregularities at a possibly rough lateral face are sufficiently compensated for by such a bearing face.

According to a preferred embodiment of the invention, the first bearing face and the second bearing face are arranged perpendicular with respect to one other. The two bearing faces abut each other preferably at a common corner edge portion. A small recess may be formed in the corner edge portion, into which possible projections of a cover layer of the board may penetrate without the tool being deflected from its path. An especially robust embodiment of the tool is characterized in that the guide means comprises a guide body and the first bearing face and the second bearing face are formed at the guide body. The handle section is connected in an advantageous manner to the guide body.

The hand forces required for guiding the tool, in particular the pressure force directed transversely to the moving direction is exerted via the handle section. For this purpose, the handle section is provided with a rest section for resting in the inner side of the hand. The handle section is advantageously designed such that it has a length substantially corresponding to a middle hand width and a cross-section that can be gripped in a haft-like manner. This cross section has in an advantageous manner a round, elliptical or also polygonal shape. The diameter of the handle section is preferably approximately 1.3 to 2.6 inches.

An embodiment of the invention that is advantageous in view of an especially favorable handling of the tool is given in that a passage opening is provided between the handle section and the guide body. The fingers of the working hand gripping around the handle section, i.e. the pointing finger, middle finger, ring finger and little finger are protected by the guide body and cannot come into contact with the workpiece. In an advantageous manner the handle section is connected to the guide body in the area of its longitudinal ends.

Such a connection can be achieved in a favorable manner in that the handle section is formed integrally with the guide body. In view of a favorable balance of the forces acting at the tool, the handle section is advantageously arranged offset towards the second guide face in the direction towards the blade means. The handle section therefore extends above the workpiece. A force acting on the handle section perpendicularly to the upper side of the workpiece does not effect a tilting of the guide body.

The holding means provided for attaching the blade means is in an advantageous manner formed by a substantially U-shaped bracket with a connection section and first and second legs projecting therefrom, wherein the two legs are provided with a holding flange in the area of their ends opposite the connection section. According to a preferred embodiment, a holding member is provided at at least one holding flange, said holding member being adjustably positionable. It is thereby possible to adjust the required pressure of the blade means in accordance with the thickness of the worked boards. Two holding members are provided for this purpose in an advantageous manner, so that the adjustment of the position of the upper blade element as well as the lower blade element becomes possible.

The holding member preferably comprises a flat, disk-like base body and is attached at the holding flange by means of a set screw means in a manner that it can be positioned if needed. The set screw means is preferably displaceably guided in an oblong cut-out The oblong cut-out can be formed in the holding member or the respective holding flange. The oblong cut-out can further form part of a torsion safety means for the set screw means or for an axial pin screw which will be explained later. According to a preferred embodiment of the invention, at least the first or the second blade element is formed by a circular rolling blade. The diameter of the blade element is preferably in the range between about 0.4 and about 2.6 inches. At the outer periphery of the blade element a circumferential, smooth, sharply ground cutting edge is provided. The blade element is preferably supported rotatably. An axial pin is provided for the rotatable support of the blade element at the holding member.

According to an especially preferred embodiment of the invention, the rolling torque of the blade element is adjustable. It is thereby achieved in an advantageous manner to adjust the thrust resistance of the tool and to additionally achieve a tangentially directed cutting force component at the outer periphery of the respective blade element. This leads to an especially advantageous cutting characteristic especially for the separation of a cardboard cover layer. The blade element is received in an advantageous manner between a frictional disk arrangement, and an axial force exerted onto the frictional disks is adjustable by means of a set screw means.

In order to form a separation face (workpiece end faces) extending substantially perpendicularly to the plane of the workpiece, the first blade element and the second blade element are arrange in a common cutting plane. Advantageously, the distance between the two blade elements is adjustable. It is thereby possible to use the tool for working boards of different thickness. It also becomes possible to adjust the pressure of the blade elements in accordance with the respective need.

The distance of the cutting plane to the first or second guide section extending on the end face of the workpiece is variable in an advantageous manner. It is thereby possible to vary the distance of the separation location to the workpiece edge and to thereby obtain strips having an appropriately adjusted strip width.

An embodiment of the invention that is particularly advantageous in view of an adjustable strip width is provided in that the U-shaped bracket is set onto a pin section and can be brought to a predetermined position by means of a fixing means. The fixing means comprises in an advantageous manner a clamping screw for clamping the bracket on the pin section.

An especially stable and precise attachment of the bracket is achieved in that the pin section has a rectangular cross-section and is formed integrally with the guide body.

According to a preferred embodiment, a second pin section is formed on a side of the guide body or of the handle section opposite said first pin section, said second pin section serving for attaching the U-shaped bracket in a direction perpendicular to the attachment direction on the first pin section. It is thereby possible to attach the bracket, if needed, in a manner that the handle means extends substantially on the workpiece plane. Thereby it is possible to urge the first guide face against the end face of the workpiece by means of the handle means.

Further details can be derived from the following description of two preferred embodiment of a tool according to the invention in connection with the drawings.

SHORT DESCRIPTION OF THE DRAWINGS

Figure 2:
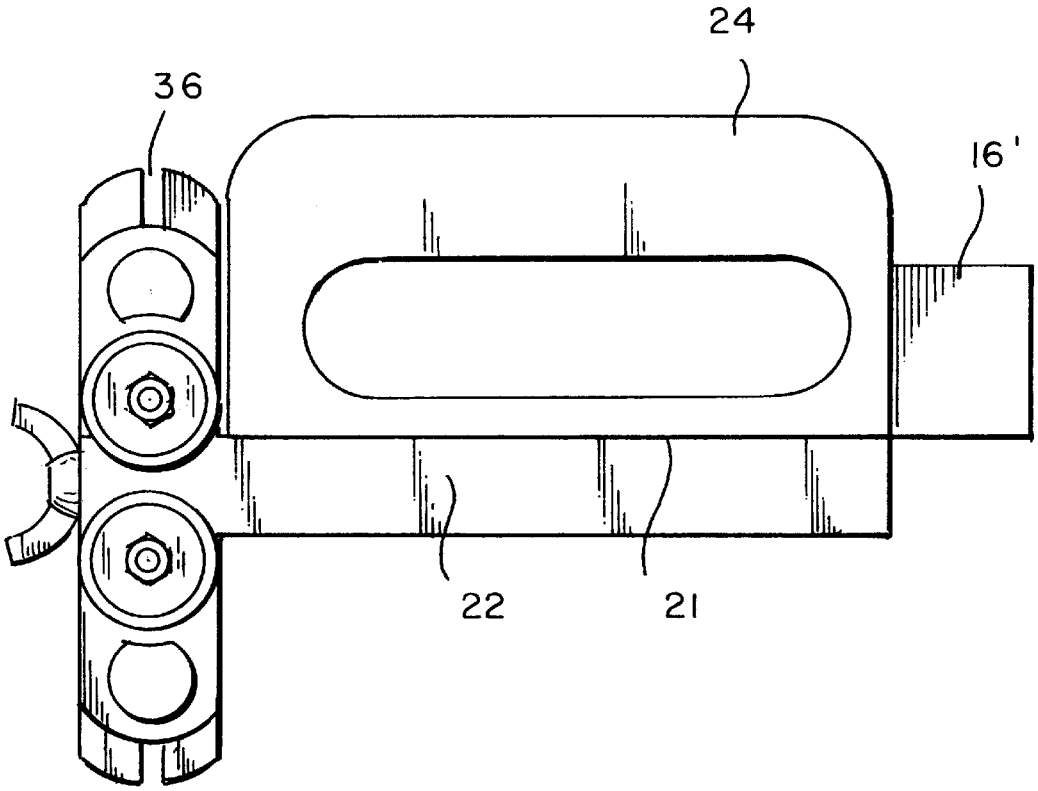
Figure 5:
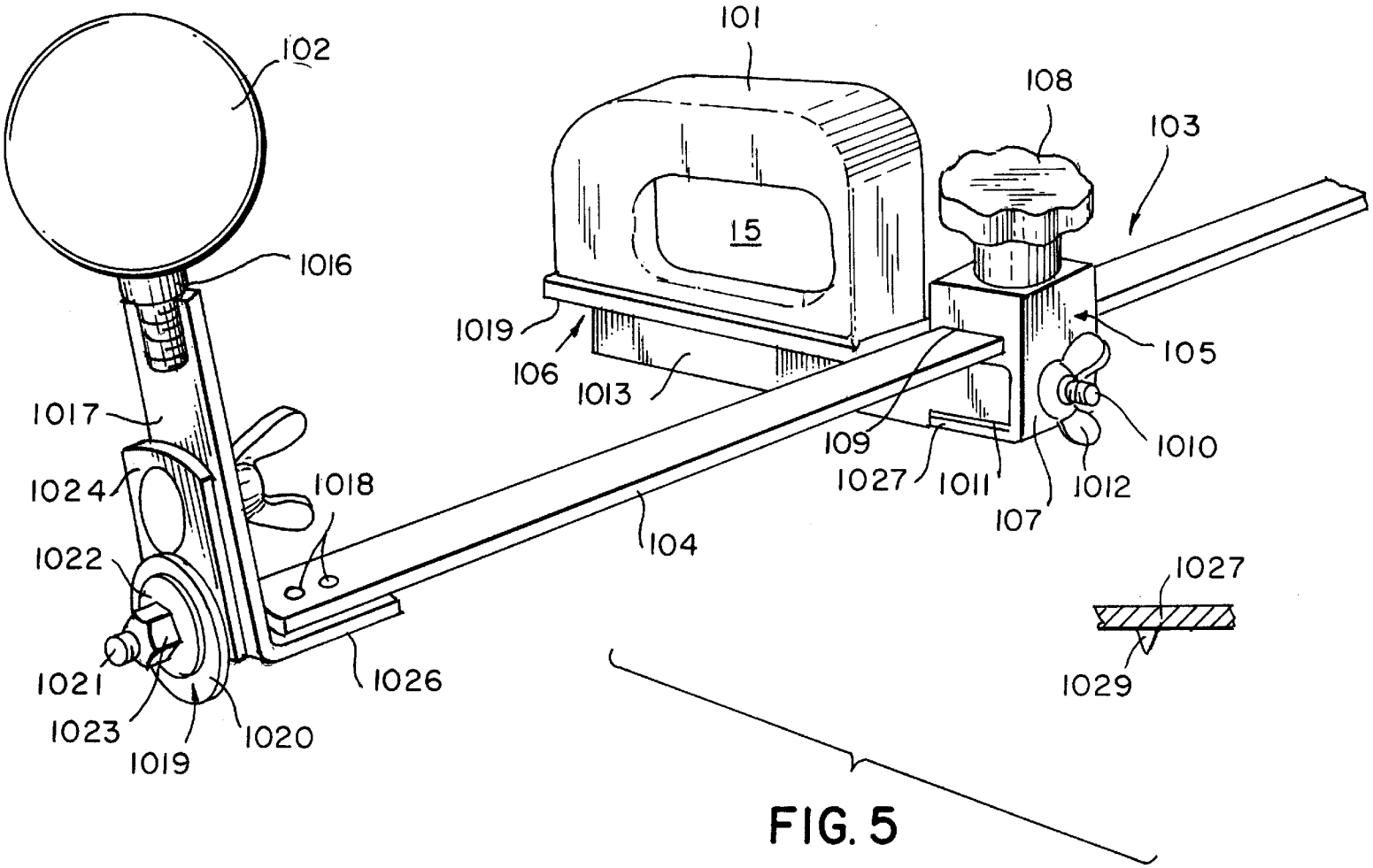

FIG. 1 is a perspective view of a first embodiment of a tool having a handle means arranged above the workpiece plane, FIG. 2 is a side view of a tool according to a second embodiment having a second positioning pin, FIG. 3 is a schematical view for explaining a preferred embodiment of handle means, guide means and blade means, FIG. 4 is a simplified sectional view through a holding member and a blade element rotatably supported therein, and an associated bearing means, and FIG. 5 is a perspective view of a further tool according to the invention having a first handle mean arranged in the area of an edge guiding means, and a second handle means arranged in the are of a rolling blade means.

DETAILED DESCRIPTION OF THE DRAWINGS

The tool shown in FIG. 1 comprises an upper rolling blade 1 and a lower rolling blade 2. Both rolling blades 1 and 2 are rotatably movable on an upper and lower axial pin 3, 4, respectively. Each axial pin 3, 4 is provided with a threaded section onto which a self-securing nut 5, 6 is screwed on.

Each axial pin 3, 4 is attached at an upper and lower holding member 7, 8, respectively. Each holding member forms part of holding means 9. The holding means 9 comprises a substantially U-shaped bracket 10. This bracket 10 is provided with an upper and lower flange 11, 12, respectively at the end portion of its two legs.

The upper and lower holding member 7, 8, respectively is attached at these two flanges in an adjustable manner by means of a set screw means 13. Through said set screw means 13, the positions of the upper and lower rolling blades 1, 2 are variable in a direction perpendicular to the workpiece plane.

The bracket 10 is guided on a positioning stud 14. The bracket 10 is fixable on the positioning stud 14 means of a clamping screw means 15. The clamping screw means comprises a threaded pin 16 aligned in the tool moving direction, a plain washer 17 and a wing nut 18. The threaded pin 16 is fixed against rotation to the positioning stud 14. The positioning stud 14 has a rectangular cross section. The longer central axis of the positioning pin cross section extends in parallel to the workpiece plane.

The holding means 9 is connected to a guide means 19 via the positioning stud 14. The guide means 19 is formed by a base body and comprises a first guide section 21 and a second guide section 22.

The first guide section 21 forms a first bearing face, which slides on a workpiece surface when setting the tool onto a workpiece.

The second guide section forms a second bearing face, which slides on an end face of the workpiece. The distance between the second bearing face and the separation element plane defined by the rolling blades 1, 2 substantially corresponds to the width of the strips to be cut off the board. This distance is infinitely variable by means of the clamping screw means 15.

The first bearing face and the second bearing face extend perpendicular to each other and parallel to the tool moving direction V.

A handle means 23 is provided above the first bearing face. The handle means comprises a handle section 24 which is connected to the base body of the guide means 19. The connection is carried out in the embodiment shown via a first and a rear connection leg 26 and 27, respectively.

A passage 25 is provided between the base body of the guide means 19 and the handle section 24, through which the fingers of the hand gripping around the handle section 24 may penetrate. The fingers gripping around the handle section 24 are effectively shielded by the base body of the guide means from the blade elements and from the workpiece (not shown).

The handle section 24 is designed in a haft-like manner and is shaped regarding its cross section in such a manner that it can be safely and tightly gripped. The handle section 24 extends substantially parallel to the tool moving direction V. The distance of the handle section 24 from the first bearing face is, in the embodiment shown, approximately 3 inches. The length of the handle section is approximately 5.5 inches. The central axis of the handle section extends offset with respect to the second bearing face (second guide section 22) in a direction towards said blade elements.

The tool shown in FIG. 2 corresponds to the workpiece described above in connection with FIG. 1, except for an additional positioning pin 15'.

The positioning pin 15' provided here is aligned such that the holding means and the bracket 10, respectively, can be attached at the guide means in a manner pivoted about 90°. In case of such a configuration of the tool, the first guide section 21 is abutted at the end face of the workpiece. The second guide section 22 slides on the flat side of the workpiece (upper side of the workpiece or lower side of the workpiece). The tool can be safely guided along an edge of the workpiece in view on the handle section 24 that can be fully gripped around.

As can be seen from FIG. 3, the guide means is supported through the first guide section 21 and through the second guide section 22 at the workpiece W. It is thereby possible to urge the tool by exerting a pressure force F directed transversely to the upper face O of the workpiece and to the end face S of the workpiece against the workpiece edge K. This leads to an especially reliable guidance of the tool so that a distance "a" between the lateral face of the workpiece S and a level "e" defined by the blade elements 1 and 2 does not vary over the entire length of a respective strip.

As can also be taken from the representation, the handle section 24 is arranged slightly offset in the direction of the blades 1, 2 with respect to the second bearing face of the second guide section (offset "z").

FIG. 4 shows a sectional view through a holding member 7 and 8, respectively, as provided in the tool according to FIG. 1.

The holding member 7 and 8, respectively forms a slide element carrying the rolling blade. The slide element is formed of a flat material section and is provided with two passage bores 28, 29. A set screw 30 and an axial pin 3 are preferably pressed into these passage bores in a manner that they are fixed against rotation.

The rolling blade 1 is set onto the axial pin 3 between a first frictional disc 31 and a second frictional disc 32. The pressure force of the frictional discs 31, 32 to the rolling blade 1 is adjustable by means of a self-securing nut 6. A washer 33 is provided between the nut 6 and the second frictional disc.

The washer 33 is displaceable in the axial direction of the axial pin 3, it is, however, secured against rotation in the circumferential direction. For this purpose the washer has an unround passage opening. The axial pin 3 is provided with a flat section which engages the washer 33.

On a side opposite the rolling blade 1, the axial pin 3 is provided with a head section 34. This head section is guided in a longitudinal hole recess 36 (see FIG. 2). The set screw 30 is also guided in the longitudinal hole recess 36. The head section 34 and the set screw 30 form a guide means through which the holding member 7 is guided linearly.

The holding member 7 can be positioned as desired without the self-securing nut 6 having to be released for this purpose. For displacing the holding member 7, only the safety nut 37 formed in this case as a wing nut must be released.

A braking torque acting onto the rolling blade 1 can be adjusted via the self-securing nut 6. It is also possible to fix the blade against rotation.

The tool described above in connection with FIGS. 1 to 4 can be used for instance as follows.

For cutting off narrow strips for instance having a width of about 3 inches from a gypsum plaster board, this board is put onto a flat support. The tool is taken. By releasing the wing nut 18, the bracket 10 becomes displaceable on the positioning stud 14. The bracket 10 is displaced in such a manner that a distance between the guide section and a level defined by blades 1 and 2, respectively, is 3 inches.

After releasing the wing nuts 13, the holding members 7, 8 are displaced on the two flanges 12. The upper holding member 7 is positioned in a manner that the circumferential edge of the blade of the upper rolling blade 1 projects approximately 0.12 inches downwards beyond the bearing face of the first guide section 21.

The holding member 8 is positioned such that the spacing between the circumferential edges of the rolling blades 1, 2 is approximately 0.12 inches smaller than the thickness of the gypsum plaster board. When displacing the holding members, these holding members are guided by the set screws 30 and the screw heads 34 of the axial pins 3, 4 in the oblong cut-out recesses 36 of the flanges 12 of the bracket 10.

The two wing nuts 13 and 18 are now fastened. The holding members 7 and 8 as well as the bracket 10 are now fixed.

The tool is set onto the workpiece. The first guide section 21 sits on the upper side of the workpiece. The second guide section 22 abuts at an end face of the workpiece. A pressure force is exerted onto the handle section, which urges the guide means 19 against the upper side of the workpiece and against the end face of the workpiece.

The rolling blades 1 and 2 are now spaced apart exactly 3 inches from the side edge (end face) of the workpiece. The tool is displaced (or possibly also drawn) along the workpiece edge by permanently pressing the guide means 19 against the upper side of the workpiece and the end face of the workpiece.

The rolling blades penetrate into the cover layers formed on both sides of the gypsum plaster board and cut same. After the tool has been moved over the entire length of the board and past the board, the tool is removed. The strip section limited by the cutting lines marked at a distance of 3 inches from the board edge is now moved forward over the front edge of the support and broken off the board by a short downward jerk.

The invention is not restricted to the above described embodiments. It is also possible for instance to immovably attach the first blade element at the bracket 10 or also at the handle means. It is also possible to make the two guide sections 21, 22 movable with respect to each other instead of an integral guide body, so that only the second guide section 22 is displaced for varying the cutting width.

The fixing of the holding means can as an alternative to the described clamping screw means also be made by different attachment means. The handle section 24 can also be aligned in a manner tilted towards the tool moving direction V. The circumferential edge of the rolling blades can also be serrated. Instead of the self-securing nut 6, counter nuts or different screw looking devices can be used. For cutting leave-like material it is possible to replace one of the two blades by a roller having a circumferential notch.

The tool shown in FIG. 5 comprises a first handle means 101 and a second handle means 102. Both handle means 101 and 102 are coupled to one another by means of a coupling means 103.

The coupling means 103 comprises a rail element 104 formed in this case by a flat steel profile. The rail element 104 is arranged in a manner that when setting the tool onto a workpiece, the flat sides of the rail element are aligned substantially parallel to the upper side of the workpiece.

The coupling means further comprises a clamping means 105 for clamping the rail element 104 to a guide means 106.

The clamping means 105 is composed, according to an embodiment that is not shown, of a bracket element 107 and a clamping screw (not visible). The clamping screw is provided with a rotary knob 108 and acts onto a side face of the rail element.

The bracket element 107 is provided with a passage opening 109 formed complementary to the cross section of the rail element 104. The rail element is guided in this passage opening in a manner that it extends substantially perpendicular to the feed direction. The bracket element 107 is attached at a pin section 1011 via a threaded bolt 1010. For this purpose a fly nut 1012 is provided.

The pin section 1011 is formed integrally with the guide means 106. The guide means comprises a lateral guide face 1013 and a rest guide face 1014.

The lateral guide face 1013 effects a guide along a side face of the workpiece. The rest guide face slides on an upper side of the workpiece. The lateral guide face 1013 and the rest guide face 1014 are arranged at a right angle to one another.

The guide means 106 is formed integrally with the first handle means 1 and is made of a plastic material. A passage opening 1015 is formed between the first handle means 1 and the guide means 106. The first handle means 101 has a substantially circular or elliptical cross section. The diameter of the cross section is in the range between 1 and 3 inches.

The second handle means comprises a spherical holding knob. This knob is connected to a final bracket 1017 via an attachment pin section 1016. The final bracket 1017 is connected to the rail element 104. For this purpose two press weld points 1018 are provided. The final bracket 107 comprises, seen in the tool moving direction, a greater width than the rail element 104. This leads to an improved guidance.

A blade means 1019 is provided in a portion below the second handle means. The blade means 1019 comprises a blade element 1020 formed as a rolling blade.

The blade element 1020 is rotatably set onto a threaded pin 1021 and secured in the axial direction via a stop disk arrangement 1022 and a polystop nut 1023. A braking torque acting onto the blade element can be adjusted via the polystop nut 1023, whereby an improved cutting characteristic is obtained.

The threaded pin 1021 is attached at a slide element 1024. The slide element 1024 is displaceably attached at the final bracket 1017 via a clamping screw nut 1025. Thereby the projection of the blade element 1020 beyond a section 1026 of the final bracket 1017 facing the workpiece in the working position can be adjusted as desired.

A slide lining made for instance of a plastic material, can be applied on said section 1026 of the final bracket 107.

To be able to perform arcuately extending cuts, if needed, a centering pin 1029 is formed in a lower section 1027 of the bracket element 107, said centering pin defining a center of rotation. The centering pin is preferably detachably arranged.

The assembly described above provided in the above-described tool and composed of coupling means 102, second handle means 1023 and blade means 1019, can be used as an extension kit for a tool as is described in the German patent application 198 00 582.2 of Jan. 9, 1998, the contents of which being incorporated herein by reference. A tool set is created thereby which enables a precise and universal working of sandwich type plaster boards.

The tool according to the invention can for instance be used as follows:

The tool is taken for accurately cutting to size gypsum plaster boards. The clamping screw connected to the rotary knob 108 is released and the distance between the cutting plane of the blade element 1019 and the lateral guide face 1013 is adjusted. The respective size can be read on a scale which is provided on an upper side of the rail element 104. The clamping screw is fixed by appropriately turning the rotary knob 108. The tool is set onto the lateral edge of the uppermost gypsum plaster board resting on a board stack. The lateral guide face 1013 and the rest guide face 104 are urged with one hand against the gypsum plaster board. The other free working hand grabs the spherical head of the second handle means and the blade element 1019 is pressed into the workpiece. The tool is now moved or drawn in the tool moving direction. The blade element rolls on the gypsum plaster board and thereby cuts the upper cardboard layer. The penetration depth of the blade element 1019 is limited by the section 1026 of the final blade.

After making the cut, the tool is removed and the gypsum plaster board is moved forward over the remaining board stack. The board projection is bent downwards by a short, strong jerk and the cardboard layer of the rear side of the board which is uncut is cut by a hook-blade knife.

What is claimed is:

1. A tool for forming separation lines in the upper and lower faces of a horizontal board-like workpiece in uniformly spaced relation relative to an edge surface thereof, comprising:

(a) a pair of rolling cutting blades (1, 2);

(b) holding means (9) supporting said blades for rotation in a common cutting plane adjacent the upper and lower surfaces of the workpiece in parallel spaced relation to the workpiece edge surface, comprising:

(1) a unitary U-shaped bracket (10) including a pair of parallel horizontal vertically-spaced leg portions having first ends connected by an integral bridging portion, said leg portions including second ends carrying a pair of outwardly bent orthogonally arranged integral vertical flange portions (11, 12), respectively;

(2) a pair of holding members (7, 8) rotatably supporting said cutting blades, respectively; and (3) first adjustment means (36, 13) connecting each of said holding members for vertical adjustment relative to said flange portions, respectively;

(c) guide means (19) for guiding said blades for cutting movement along lines of cut spaced a given distance from the workpiece edge surface, respectively, said guide means including an elongated guide body having:

(1) a horizontal first guide face (21) for engaging the upper face of the workpiece; and (2) a vertical second guide face (22) parallel with said cutting plane for engaging the edge surface of the workpiece;

(3) said guide body being arranged normal to said bracket means and including an end portion carrying a positioning stud (14) that extends within the space defined between said bracket leg portions;

(d) second adjustment means (15) connecting said bracket means for adjustment in a direction transverse of said guide body, thereby to vary the distance between said cutting plane and the edge of the workpiece; and (e) handle means (23) integral with said guide body for arranging said guide body with its first and second guide faces in engagement with the corresponding surfaces of the workpiece, and for horizontal displacing said guide body in a direction parallel with said cutting plane.

2. A tool as defined in claim 1, wherein each of said rolling blade has a circular cutting edge having a diameter from about 0.4 to 2.6 inches; and further wherein said each of said holding members includes a shaft for rotatably supporting the associated rolling blade.

* * * * *